US006834923B2

(12) United States Patent
Young et al.

(10) Patent No.: US 6,834,923 B2
(45) Date of Patent: Dec. 28, 2004

(54) MINIATURE SOLID BEARING SLIDE ASSEMBLY

(75) Inventors: John Nan-Heng Young, Diamond Bar, CA (US); Gary Scott Loutzenheiser, Costa Mesa, CA (US); Cesar Cordero Mallari, Corona, CA (US); John Ronald Nicholas, Yorba Linda, CA (US)

(73) Assignee: Jonathan Manufacturing Corporation, Irvine, CA (US)

( * ) Notice: Subject to any disclaimer, the term of this patent is extended or adjusted under 35 U.S.C. 154(b) by 0 days.

(21) Appl. No.: 10/364,926

(22) Filed: Feb. 10, 2003

(65) Prior Publication Data

US 2004/0155563 A1 Aug. 12, 2004

(51) Int. Cl.[7] ..... A47B 88/04

(52) U.S. Cl. ..... 312/334.8; 312/334.1; 312/334.7; 312/334.16

(58) Field of Search ..... 312/334.8, 334.1, 312/334.7, 334.16, 334.22, 334.23

(56) References Cited

U.S. PATENT DOCUMENTS

| | | | | |
|---|---|---|---|---|
| 1,071,006 A | * | 8/1913 | Little | 312/334.8 X |
| 1,231,291 A | | 6/1917 | Otte | |
| 2,277,702 A | | 3/1942 | Kennedy | |
| 2,277,703 A | | 3/1942 | Kennedy | |
| 2,295,697 A | | 9/1942 | Sulentic | |
| 3,133,768 A | * | 5/1964 | Klakovich | 312/334.8 X |
| 3,328,107 A | | 6/1967 | Gutner | |
| 3,650,577 A | | 3/1972 | Gutner | |
| 3,837,559 A | | 9/1974 | Greenberger | |
| 3,981,553 A | | 9/1976 | Gutner | |
| 4,072,375 A | | 2/1978 | Boone | |
| 4,305,625 A | | 12/1981 | Gutner et al. | |
| 4,384,746 A | | 5/1983 | Ferdinand et al. | |
| 4,440,461 A | | 4/1984 | Powell et al. | |
| 4,749,243 A | | 6/1988 | Röck et al. | |
| 5,403,097 A | | 4/1995 | Woof | |
| 6,069,769 A | | 5/2000 | Dorius et al. | |
| 6,076,908 A | | 6/2000 | Maffeo | |
| 6,145,945 A | | 11/2000 | Parvin | |

* cited by examiner

*Primary Examiner*—Rodney B. White
(74) *Attorney, Agent, or Firm*—Knobbe Martens Olson & Bear LLP

(57) ABSTRACT

A telescoping slide assembly having at least a first slide segment and a second slide segment. Desirably, each of the first and second slide segments include one or more solid bearing surfaces and are in contact with one another along at least a portion of the bearing surfaces. Preferably, the bearing surfaces are curved and the contact between the slide segments occurs along a lateral distance, which is less than one-half of the distance of the smaller bearing surface. In one arrangement, the slide assembly includes a third slide segment telescopingly engaged with one of the first or second slide segments.

12 Claims, 4 Drawing Sheets

MINIATURE SOLID BEARING SLIDE ASSEMBLY

BACKGROUND OF THE INVENTION

1. Field of the Invention

The present invention relates generally to telescoping slide assemblies. More particularly, the present invention relates to a slide assembly that occupies a reduced cross-sectional area while maintaining a high load rating, and being especially well-suited for use in 1U and 2U internet server mounting applications.

2. Description of the Related Art

The hardware components comprising a computer server, such as an internet server, for example, are arranged and secured within a metal or plastic enclosure, or chassis. The server/chassis assembly is then typically housed within an enclosed cabinet, often containing multiple servers arranged in a vertical manner. In one particularly advantageous arrangement, each chassis is mounted on a pair of telescoping slide assemblies so that the server may be easily withdrawn from the cabinet for inspection, repair or replacement. It is contemplated that 1U and 2U servers will comprise the majority of the future internet server market.

A large number of cabinets, each containing multiple computer servers, often covering thousands, or tens of thousands, of square feet of floor space may be found in a single location. Storage costs for computer servers are typically calculated on a basis of square feet of floor space occupied per server. Accordingly, it is highly desirable to reduce the area occupied by the cabinets, in order to maximize the number of cabinets, and thus servers, that may be stored in a given area.

One impediment to reducing cabinet dimensions has been the cross-sectional size of the available slide assemblies, or "slide", for short. Additionally, in an effort to reduce design and purchasing costs, it is desirable to provide a single slide that is suitable for both the 1U and 2U server applications. Therefore, a need exists for a slide of reduced cross-sectional area that is structurally capable of supporting a vertical load produced by either a 1U or 2U internet server.

Additionally, in a computer server application, it is highly desirable to utilize an over-travel type slide assembly. An over-travel slide is capable of extending a greater distance than the length of any one of the individual slide segments. By utilizing an over-travel slide, the server may be completely withdrawn from the cabinet to permit access to the rearward end of the server where cables, such as power cables or networking cables, may be located. A common over-travel slide has three, or more, individual slide segments telescopingly engaged with one another. For example, in a three-segment slide assembly, an outer slide segment may be connected to the cabinet and an inner slide segment may be connected to the computer server chassis. An intermediate segment may interconnect the outer slide segment and the inner slide segment.

In some slide assemblies, a plurality of bearings may be interposed between the inner slide segment and the intermediate slide segment and between the intermediate slide segment and the outer slide segment. The bearings permit the slide segments to move relative to one another with very little resistance due to friction. As a result, the slide assembly is capable of supporting a relatively large load while remaining capable of extending and retracting with relatively little effort. However, in many common arrangements, the inclusion of bearings inhibits the ability to construct a three-segment slide assembly within a desirable cross-sectional envelope.

As a result, solid bearing slide assemblies are sometimes utilized for the computer server market. In a solid bearing, or friction, slide assembly, the individual slide segments are typically in direct contact with one another. However, in many prior art friction slides, such direct contact between the individual slide segments results in an excessive degree of resistance to extension or retraction due to relatively high friction between the slide segments. In addition, the height and/or position of the flat, horizontal contact surfaces may vary due to normal manufacturing tolerances such that an unacceptable amount of relative, vertical movement is permitted between the individual slide segments.

For example, a common over-travel, solid bearing slide assembly is illustrated in FIG. 1. The slide assembly 1 is a three-piece slide assembly having an inner slide segment 2, an intermediate slide segment 3 and an outer slide segment 4. The inner slide segment 2 is slideably engaged with the intermediate slide segment 3 which, in turn, is slideably engaged with the outer slide segment 4. The inner slide segment 2 defines substantially flat upper and lower contact surfaces 5, which contact substantially flat upper and lower contact surfaces 6 of the intermediate slide segment 3, respectively. Substantially flat upper and lower contact surfaces 7 of the intermediate slide segment 3 contact substantially flat upper and lower contact surfaces 8 of the outer slide segment 4.

The relatively large contact surface area between the individual slide segments 2, 3, 4, due to the substantially flat contact surfaces 5–8, results in a relatively large degree of friction when the slide segments 2, 3, 4 are moved with respect to one another. In addition, as described in greater detail below, the manufacturing process commonly used to form the slide segments 2, 3, 4 often results in an undesirable amount of vertical movement of the slide segments 2, 3, 4 relative to one another. Such undesirable relative motion is perceived by consumers as a looseness, or slop, of the slide assembly 1, which may cause concern regarding the adequacy of the support provided by the slide assembly 1 and result in a negative opinion regarding the quality of the slide assembly 1.

SUMMARY OF THE INVENTION

Accordingly, preferred embodiments of the present slide assembly are capable of supporting a 1U or 2U internet server and have a compact cross-sectional area, allowing the slide to sit within a 1"×⅜" cross-sectional envelope. Additionally, preferred embodiments of the present slide assembly are of a solid bearing construction wherein the individual slide segments include surfaces in direct contact with one another. Preferably, the contact surfaces are configured to have a relatively small surface area of the individual slide segments in contact with one another. Such an arrangement reduces the frictional, resistive force developed when the slide assembly is extended or retracted while supporting an object. Preferably, the contact surfaces are substantially continuously curved. In addition, the curved contact surfaces may be manufactured with conventional techniques to have a higher degree of dimensional precision and thereby reduce the amount of relative vertical movement between the individual slide segments in comparison to prior slide assemblies.

A preferred embodiment is a slide assembly including a first slide segment having a web, a first upper portion and a first lower portion spaced from one another along the web. The first upper portion defines a curved lower surface and the first lower portion defines an upper curved surface. A second slide segment is telescopingly engaged with the first slide segment and includes a web, a second upper portion and a second lower portion spaced from one another along the web. The second upper portion has a curved portion defining an innermost vertical surface, an outermost vertical surface and an upper curved surface extending from the innermost surface to the outermost surface. The second lower portion has a curved portion defining an innermost vertical surface, an outermost vertical surface and a lower curved surface extending between the innermost surface and the outermost surface. The lower curved surface of the first upper portion is configured to directly contact the upper curved surface of the second upper portion and the upper curved surface of the first lower portion is configured to directly contact the lower curved surface of the second lower portion.

Another preferred embodiment is a slide assembly including a first slide segment having a web, a first upper portion and a first lower portion spaced from one another along the web. The first upper portion defines a lower surface and the first lower portion defines an upper surface. A second slide segment is telescopingly engaged with the first slide segment and includes a web, a second upper portion and a second lower portion spaced from one another along the web. The second upper portion defines an innermost vertical surface, an outermost vertical surface and an upper surface extending from the innermost surface to the outermost surface. The second lower portion defines an innermost vertical surface, an outermost vertical surface and a lower surface extending between the innermost surface and the outermost surface. The upper surface of the second upper portion is configured to contact the lower surface of the first upper portion along an upper contact length of less than one-half of a distance between the innermost vertical surface and the outermost vertical surface of the second upper portion. Similarly, the lower surface of the second lower portion is configured to contact the upper surface of the first lower portion along a lower contact length of less than one-half of a distance between the innermost vertical surface and the outermost vertical surface of the second lower portion.

A further preferred embodiment is a slide assembly including a first slide segment having a web, a first upper portion and a first lower portion spaced from one another along the web. The first upper portion defines a continuously curved contact surface and the first lower portion defines a continuously curved contact surface. A second slide segment is telescopingly engaged with the first slide segment and includes a web, a second upper portion and a second lower portion spaced from one another along the web. A third slide segment includes a web, a third upper portion and a third lower portion spaced from one another along the web, the third upper portion defining a continuously curved contact surface and the third lower portion defining a continuously curved contact surface. A first curved surface of the second upper portion is in direct contact with a portion of the contact surface of the first upper portion and a first curved surface of the second lower portion is in direct contact with a portion of the contact surface of the first lower portion. Further, a second curved surface of the second upper portion is in direct contact with a portion of the contact surface of the third upper portion and a second curved surface of the second lower portion is in direct contact with a portion of the contact surface of the third lower portion.

BRIEF DESCRIPTION OF THE DRAWINGS

The above-mentioned, and other features, aspects and advantages of the present invention are described with reference to drawings of a preferred embodiment. The illustrated embodiment of the slide assembly is intended to exemplify, but not to limit, the present invention. The drawings contain five figures.

DETAILED DESCRIPTION OF THE PREFERRED EMBODIMENT

A slide constructed in accordance with the present invention provides utility in a wide variety of applications. However, the preferred embodiment of the slide disclosed herein is particularly well-suited for use in computer hardware applications and, in particular, for mounting 1U and 2U internet servers within a server support structure, or cabinet. Accordingly, the present slide assembly will be described in the environment of a computer server mounting application, however, such a description of use is not intended to limit the present invention.

The individual hardware components comprising a computer server are typically housed within a chassis. When the term "server" is used herein, it is typically intended to include the server/chassis assembly, unless otherwise indicated. A common 1U server may have approximate dimensions (width×depth×height) of 17¾"×20"×1¾" and may weigh approximately 30–35 lbs. A common 2U server may have dimensions of approximately 17¾"×24"×3½" and may weigh approximately 60–70 lbs. Preferably, a slide assembly constructed in accordance with the principles disclosed herein is suitable for use with either a 1U or 2U server and, preferably, is constructed to support an object of at least about 100 lbs.

Figure 2:
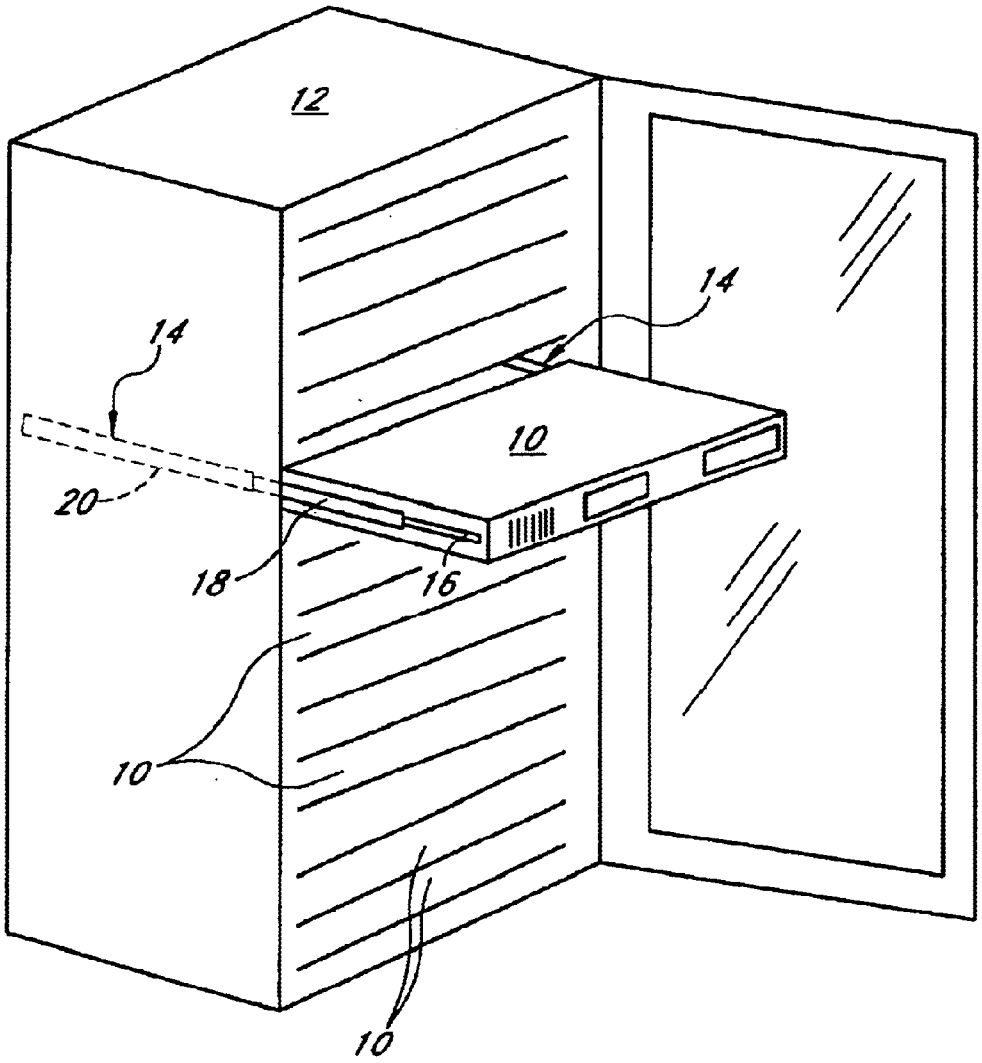
FIG. 2 is a perspective view of a computer server cabinet with one server in a withdrawn position from the cabinet. The server is shown mounted to the cabinet with a pair of preferred slide assemblies supporting opposing sides of the server.

FIG. 2 illustrates a plurality of computer servers 10 held within a cabinet 12. Each server 10 is connected to the cabinet 12 by a pair of slides 14 positioned on opposing sides of the server 10. The slides 14 are constructed for substantially linear movement between a fully retracted position and the fully extended position. A single server 10 is illustrated with an associated pair of slides 14 in a filly extended position.

As discussed above, the slides 14 preferably are constructed such that, in their fully extended position, the server 10 is completely withdrawn from the cabinet 12. Advantageously, such an arrangement allows easy access to the server 10 for purposes such as installation, modification or repair. As described in greater detail below, the slides 14 are constructed with sufficient strength to support a 1U or 2U server while, at the same time, occupying a minimum amount of space. Such an arrangement advantageously reduces wasted space (i.e., non-server space) within the cabinet 12, allows the cabinet 12 to be constructed with reduced dimensions and, thus, maximizes the number of servers 10 that may occupy a given area.

The slide assembly 14 includes an inner slide segment 16, an intermediate slide segment 18, and an outer slide segment 20. In the illustrated arrangement, the outer slide segment 20 is fixed to the cabinet 12 and the intermediate slide segment 18 is supported by the outer slide segment 20. The inner slide segment 16 is supported by the intermediate slide segment 18 and supports the server 10. However, in some arrangements, this configuration may be reversed such that the slide segment having the smallest cross-section (i.e., the inner slide segment 16) is fixed to the cabinet 12 and the larger, or outer slide segment 20 is fixed to the server 10. In addition, other arrangements are possible, wherein one or more of the individual slide segments have the same, or substantially similar, cross-sectional shapes and/or dimensions.

Figure 3:
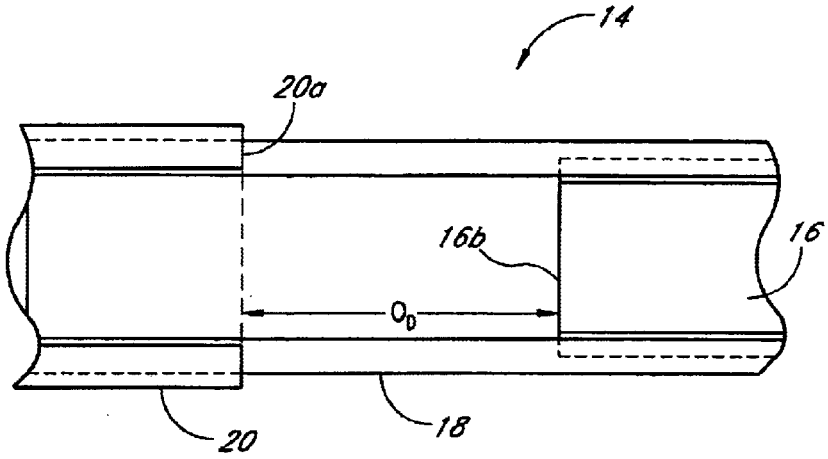
FIG. 3 is a side view of a portion of the slide assembly of FIG. 2 in a fully extended position.

With reference to FIG. 3, the slide assembly 14 is shown in a fully extended position wherein the inner slide segment 16 is fully withdrawn from the outer slide segment 20. In the fully extended position, the slide assembly 14 defines an extended length, which desirably is greater than the length of any one of the individual slide segments 16, 18, 20. Thus, when the slide assembly 14 is in its fully extended position, a distance $O_D$ is defined between a forward end 20A of the outer slide segment 20 and a rearward end 16B of the inner slide segment 16. The distance $O_D$ is referred to as the over-travel distance, as is well known in the art.

As will be appreciated by one of skill in the art, when an over travel type slide assembly is in a filly extended position, the intermediate slide segment must be capable of withstanding substantially the entire load carried by the slide without suffering permanent deformation and, preferably, without significant deflection. Preferably, the intermediate slide segment 18 of the illustrated slide assembly 14 is configured to support a load of at least 30 pounds being carried by the slide 14 without permanent deformation. More preferably, the intermediate slide 18 is configured to support a load of at least 100 pounds being carried by the slide 14 without permanent deformation. As will be apparent to one of skill in the art, in other slide applications, the intermediate slide segment may be configured to support a lesser, or much greater, load.

Figure 4:
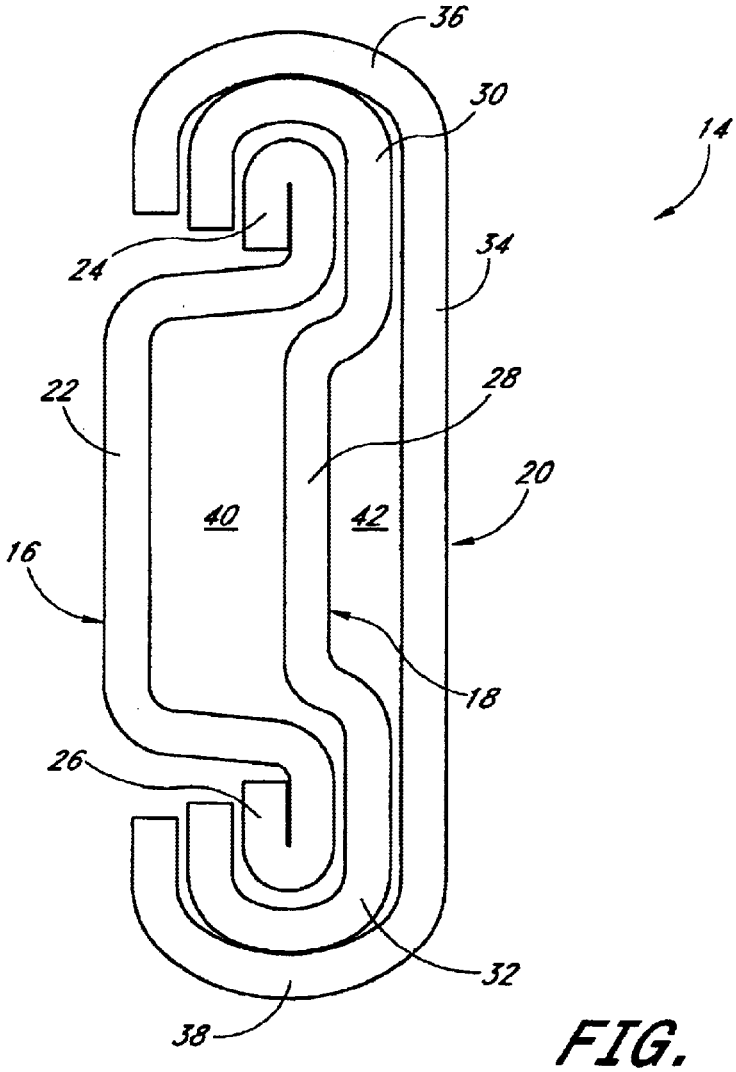
FIG. 4 is a cross-sectional view of the slide assembly of FIG. 2.
Figure 5:
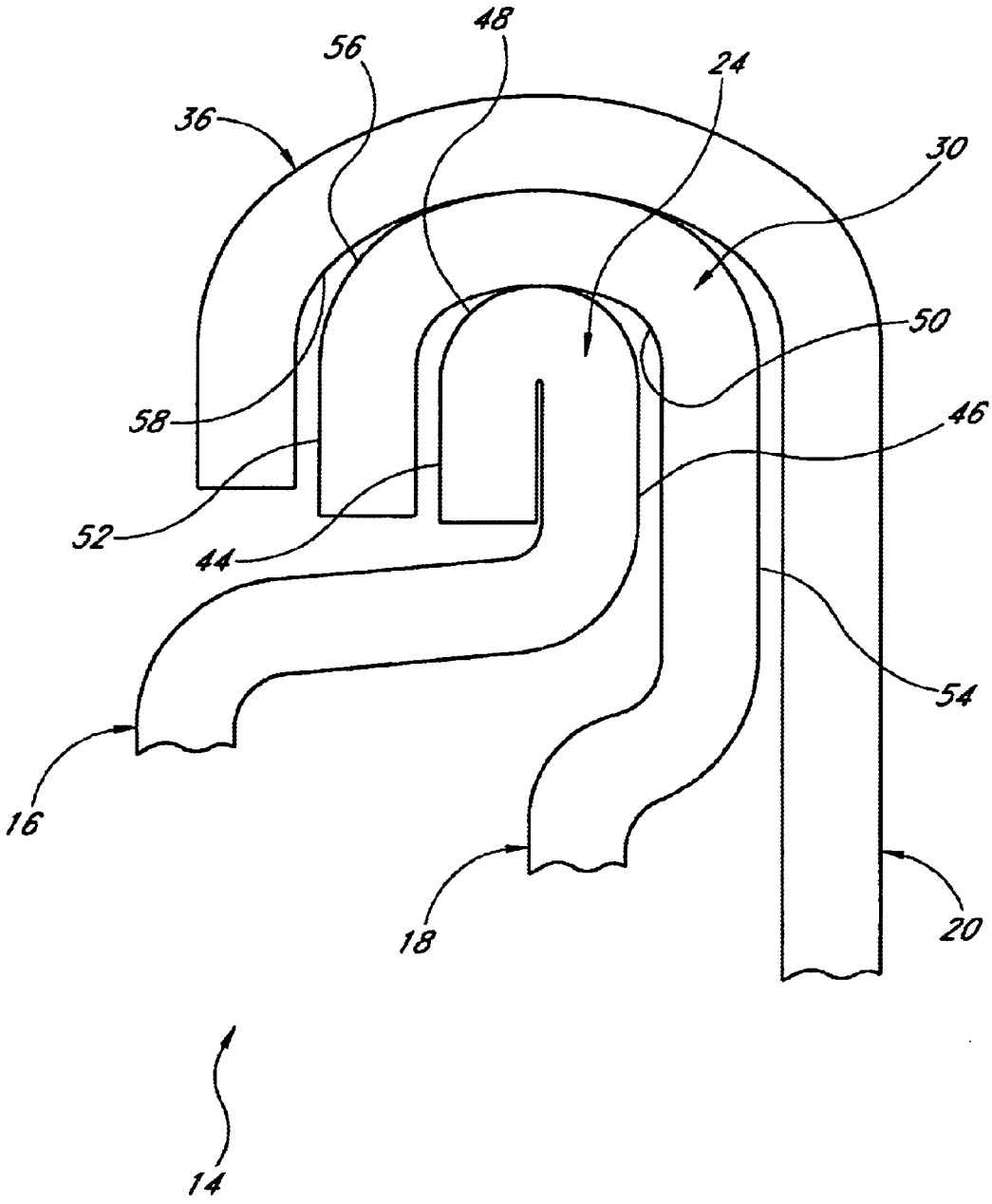
FIG. 5 is an enlarged cross-sectional view of an upper portion of the slide assembly of FIG. 4.

With reference to FIGS. 4 and 5, the slide assembly 14 is shown in section. Desirably, the slide assembly 14 maintains substantially the same cross-sectional shape and size as illustrated in FIGS. 4 and 5 throughout its length. Accordingly, when specific dimensions, or shapes, of the cross-section of the slide 14, or individual segments thereof, are referred to, it may be assumed that such features remain substantially consistent throughout the length of the slide, or slide segments. Therefore, it follows that specific points or distances described in relation to the slide's 14 cross-section, when extended along the length of the slide 14, become lines or areas, respectively, unless it is otherwise noted or apparent within the text of the disclosure.

The inner slide segment 16 includes a web 22 extending between an upper portion 24 and a lower portion 26. Similarly, the intermediate slide segment 18 includes a web 28 extending between an upper portion 30 and a lower portion 32. The upper and lower portions 30, 32 of the intermediate slide segment 18 extend in a generally semi-circular manner from the web 28 generally wrapping around the upper and lower portions 24, 26 of the inner slide segment 16.

The outer slide segment also includes a web 34 extending between an upper portion 36 and a lower portion 38. In a manner similar to the intermediate segment 18 described immediately above, the upper and lower portions 36, 38 of the outer slide segment 20 extend in a generally semi-circular manner from the web 34 to generally enclose the upper and lower portions 30, 32 of the intermediate slide segment 18.

Desirably, a central portion of the vertical webs 22, 28 of the inner and intermediate slide segments 16, 18, respectively, are offset from the remainder portion of the webs 22, 28 such that the center portions of the all three webs 22, 28, 34 are spaced approximately equidistant from each other. Desirably, outside surfaces of the inner web 22 and the outer web 34 define a maximum width dimension of the slide assembly 14. As described above, preferably, this dimension is less than or equal to three-eighths of an inch. In addition, the outer slide segment 20 defines a height of the slide assembly 14, which is preferably about one inch or less.

Advantageously, the spacing of the central portions of the webs 22, 28, 34 provides clearance space for fasteners used to secure the slide assembly 14 to a support structure, such as the cabinet 12 and to secure an object, such as the server 10, to the slide assembly 14. Preferably, a space 40 is defined between the vertical web 22 of the inner slide segment 16 and the vertical web 28 of the intermediate slide segment 18. Similarly, a space 42 is defined between a vertical web 28 and the vertical web 34 of the outer slide segment 20. Typically, in a computer server environment, the outer slide segment 20 is connected to the server cabinet 12 (FIG. 2) and the inner slide segment 16 is connected to the computer server 10 (FIG. 2). Any suitable method for connecting the inner and outer slide segments 16, 20 to the server 10 and cabinet 12, respectively, may be used, such as bracketry, for example. The spaces 40, 42 provide clearance for fastening members utilized to connect the server 10 and the cabinet 12 to the slide assembly 14, as is well known in the art. The above-described arrangement permits the spaces 40, 42 to be sized and shaped such that common mounting fasteners may be utilized despite the desirably small cross-sectional envelope of the slide assembly 14.

With reference to FIG. 5, an upper portion of the slide assembly 14 is shown in section. As mentioned previously, the slide segments 16, 18, 20 desirably include solid bearing contact surfaces therebetween. Preferably, the contact surfaces are configured to reduce the contact surface area between the individual slide segments 16, 18, 20.

The upper portion 24 of the inner slide segment 16 desirably includes two adjacent wall portions and, thus, is approximately twice as thick as the web portion 22 of the inner slide segment 16. Preferably, the adjacent wall portions are in contact with one another and, more preferably, the adjacent wall portions are formed from a continuous piece of material. That is, an upper end of the inner slide segment 16 is bent over onto itself to define the upper portion 24.

As a result, the upper portion 24 includes an inner, vertical surface 44, which is substantially parallel to both the central portion of the web 22 and a vertical plane of the slide assembly 14. The upper portion 24 also includes an outer, vertical surface 46 that, preferably, is substantially parallel to the inner surface 44. As referred to herein, inner surface indicates the surface closest to the central portion of the web 22 of the inner slide segment 16 and outer surface indicates a surface closest to the central portion of the web 34 of the outer slide segment 20. Such references are provided for the purpose of convenience, and are not intended as a limitation of the present invention. A substantially semi-circular solid bearing surface 48 extends between the inner surface 44 and the outer surface 46 of the upper portion 24.

The upper portion 30 of the intermediate slide segment 18 is generally semi-circular in shape and is sized to substantially surround, or encompass, the upper portion 24 of the inner slide segment 16, with the exception of a space provided to accommodate the web 22 of the inner slide segment 16. With such an arrangement, the upper portion 30 captures the upper portion 24 to substantially prevent lateral movement of the inner slide segment 16. In addition, together with the lower portion 32 of the intermediate segment 18, the upper portion 30 of the intermediate segment 18 supports the inner segment 16 in a vertical direction, as will be readily appreciated by one of skill in the art.

The upper portion 30 includes a lower, curved surface 50, which is arranged to contact the solid bearing surface 48 of the inner slide segment 16. Desirably, the curved surface 50 has a single, substantially continuous radius. Advantageously, the surfaces 48 and 50 are sized and shaped such that contact therebetween is over a limited distance, in section, and a limited surface area along the length of the segments 16, 18. Preferably, the contact between the surfaces 48 and 50 is limited to a point, in section, and a line, along the length of the segments 16, 18. As described above, such an arrangement reduces the frictional resistance to relative movement between the inner segment 16 and intermediate segment 18, when the slide assembly 14 is supporting a load.

Preferably, the intermediate segment 18 is configured to contact the outer slide segment 20 in a manner substantially identical to the contact between the inner segment 16 and intermediate segment 18, described immediately above. Specifically, the upper surface of the upper portion 30 of the intermediate slide segment 18 includes a substantially vertical inner surface 52, a substantially vertical outer surface 54, and a solid bearing contact surface 56 extending between the inner and outer surfaces 52, 54. Desirably, the solid bearing contact surface 56 is substantially continuously curved from the inner surface 52 to the outer surface 54.

The upper portion 36 of the outer slide segment 20 is generally semi-circular in shape and generally surrounds the upper portion 30 of the intermediate slide segment 18. The upper portion 36 defines a curved, lower surface 58 which is arranged to contact the solid bearing surface 56 of the intermediate slide segment 18. Desirably, the surfaces 56, 58 are sized and shaped such that contact therebetween is over a limited distance, in section, and a limited surface area along the length of the slide segments 18, 20 and, more preferably, contact occurs at a single point, in section, and a line, along the length of the segments 18, 20. As described above, the limited contact surface area between the slide segments 18 and 20 advantageously reduces the friction between the segments 18, 20 to permit the slide assembly 14 to be extended and retracted with less resistance than prior solid bearing slide assembly designs.

The upper and lower portions 36, 38 of the outer slide segment 20 supports the intermediate slide segment 18 in a vertical direction and substantially prevents lateral movement of the intermediate segment 18 relative to the outer segment 20. Accordingly, with such an arrangement, the slide segments 16, 18 are substantially limited for movement in a telescoping fashion with respect to the outer segment 20, as is well known in the art.

If manufacturing processes were perfect, it would allow the formation of a perfect semi-circular profile of the surfaces 48 and 56 of the inner and intermediate slide segments 16, 18 and the contact therebetween would comprise a single contact point and thus, would define a contact line extending along the length of the slide segments 16, 18. Such a point contact arrangement would allow relative movement of the slide segments 16, 18, 20 with minimum frictional resistance. In actuality, contact between the individual segments 16, 18, 20 may exist along a small lateral (i.e., cross-sectional) distance, rather than the theoretical point, as will be appreciated by one of skill in the art. In any event, it is desirable that contact between any two segments is less than about one-half the lateral distance of the smaller contact surface (i.e., the contact surface of the inner segment 16 in contact between the inner segment 16 and the intermediate segment 18 and the contact surface of the intermediate segment 18 in contact between the intermediate segment 18 and the outer segment 20). More desirably, the contact between any two segments is less than about one-third of the lateral distance of the smaller contact surface and, preferably, less than about one-fourth of the lateral distance of the smaller contact surface. More preferably, the contact between any two segments is less than about one-fifth of the lateral distance of the smaller contact surface and, most preferably, less than about one-tenth of the lateral distance of the smaller contact surface. Although the preferred contact between the curved surfaces of the segments is described as a distance above, it may also be described as an arcuate length along the curved surface. However, in the context of a slide assembly having relatively small curved contact surfaces, it may be assumed that a lateral distance is substantially equal to an arcuate length along the curved surface.

Furthermore, in order to achieve a desirable balance between permitting low-friction, relative linear movement (i.e., extension and retraction) between the slide segments 16, 18, 20 and inhibiting excessive relative lateral movement (or slop) between the slide segments 16, 18, 20, it has been determined that a preferred relationship exists between the radii of contacting surfaces of the interconnected segments, 16, 18 and 18, 20. For example, if the difference between the radius of the supporting contact surface (i.e., 48 or 56) and the surrounding, or supported, contact surface (i.e., 50 or 58) is too small, friction during relative, linear movement of the slide segments 16, 18, 20 may be high. Conversely, if the difference is too large, excessive lateral slop between the slide segments 16, 18, 20 may be present.

Accordingly, in a presently preferred arrangement, the value of the radius of the contact surface 48 of the inner segment 16 desirably is between about 30% to 95% and, preferably between about 30% to 45%, of the value of the radius of the corresponding contact surface 50 of the intermediate segment 18. More preferably, value of the radius of the contact surface 48 of the inner segment 16 desirably is about 37% of the value of the radius of the corresponding contact surface 50 of the intermediate segment 18. Similarly, the value of the radius of the contact surface 56 of the intermediate segment 18 desirably is between about 80% to 95%, and more preferably between about 80% to 90%, of the value of the radius of the corresponding contact surface 58 of the outer segment 20. More preferably, the value of the radius of the contact surface 56 of the intermediate segment 18 is about 86% of the value of the radius of the corresponding contact surface 58 of the outer segment 20. The specific values recited above are presently preferred for certain, small cross-sectional slide assemblies well-suited for use in mounting computer servers, for example. Accordingly, other values may be preferred for slide assemblies designed for other applications, as may be determined by one of skill in the art.

Although not separately illustrated, the lower portions 26, 32, 38 of the slide segments 16, 18, 20 are constructed in a substantially identical manner to the upper portions 24, 30, 36. Thus, preferably, the lower portions 26, 32,, 38 also contact one another along corresponding contact surfaces, the radii of which are sized relative to one another in accordance with the principles outlined above.

Desirably, the slide 14 is constructed such that both the upper portions 24, 30, 36 and the lower portions 26, 32, 38 remain in contact with one another in any position of the slide assembly 14. However, as will be appreciated by one of skill in the art, there may be some vertical clearance between the individual slide segments 16, 18, 20 such that only one or the other of the upper portions 24, 30, 36 or lower portions 26, 32, 38 are in contact with one another at a specific position of the slide assembly. For example, when the slide assembly 14 is in a fully closed position, only the lower portions 26, 32, 38 may be in contact with one another in supporting the weight carried by the slide assembly 14 while a small amount of clearance space may be present between the upper portions 24, 30, 36. As the inner slide segment 16 and/or intermediate slide segment 18 is extended such that a center of gravity of the object carried by the slide assembly 14 extends beyond the forward end 20A (FIG. 3) of the outer slide segment 20, the inner and intermediate slide segments 16, 18 may pivot such that both the lower portions 26, 32, 38 and upper portions 24, 30, 36 are in contact with one another. However, as will be appreciated by one of skill in the art, the contact therebetween may not extend for the entire length of the slide assembly 14.

As will be readily determined by one of skill in the art, any of a number of suitable stop mechanisms may be utilized to define a relative position of the slide assembly 14, such as a fully closed or fully extended position, for example. A stop mechanism may also be used to define mid-positions of the slide assembly 14, such as a desired position between the fully closed and fully extended positions of the slide assembly 14, or any two segments thereof. Additionally, if desired, any suitable type of lock mechanism, or detent mechanism, may be utilized to releasably secure the slide assembly 14, or any two segments of the slide 14, in a fully closed and/or fully extended position, or any desirable position therebetween. Further, any suitable type of sequencing arrangement may be provided to control the order in which the slide segments extend or retract. For example, friction or mechanical type sequencing arrangements may be used.

Figure 1:
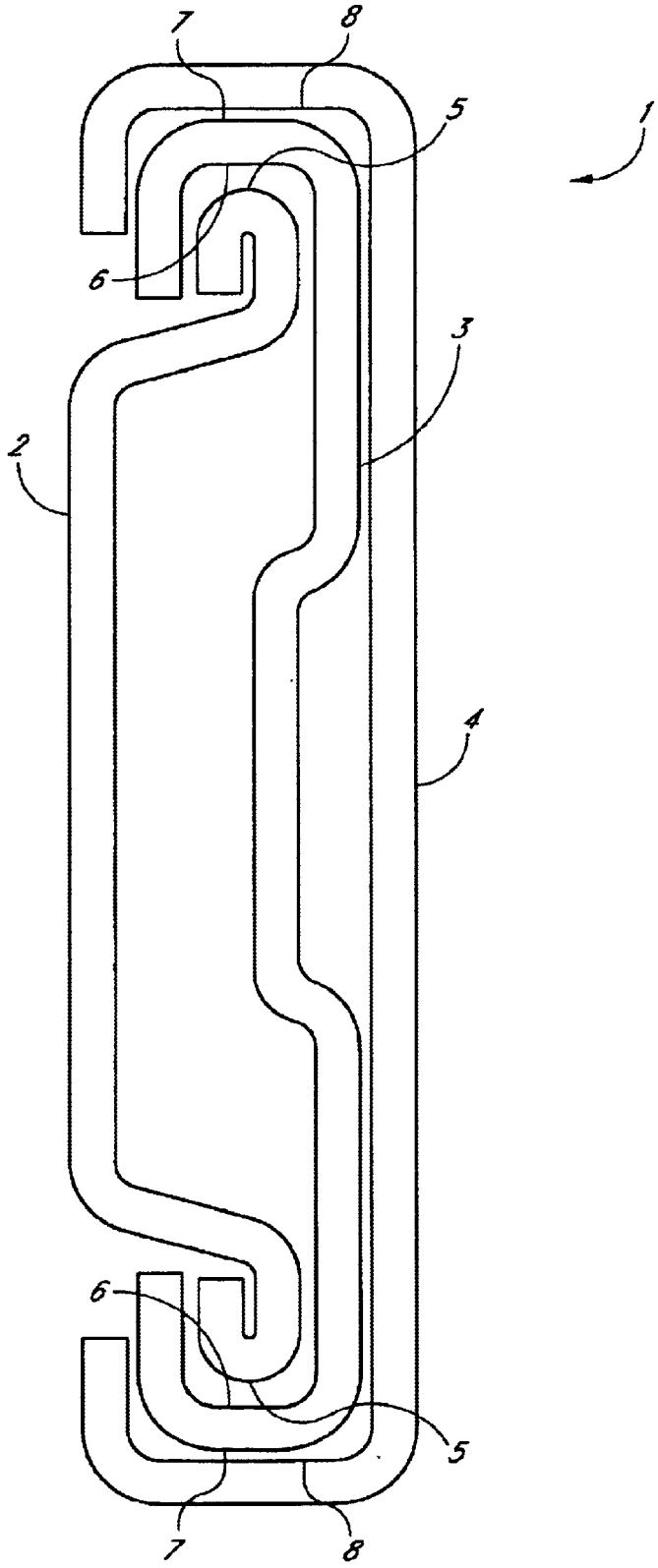
FIG. 1 (PRIOR ART)
FIG. 1 is a cross-sectional view of a prior art slide assembly.

With reference to FIG. 1, as described previously, prior solid bearing slide assemblies 1 possess several inherent disadvantages. For example, the flat contact surfaces between the individual segments 2, 3, 4 result in a large contact surface area therebetween, which increases the friction and, thus, the resistance to relative movement of the slide segments 2, 3, 4.

Additionally, the distance between the upper and lower contact surfaces 8 of the outer segment 14 must be adequate to receive the intermediate slide segment 3, the height of which is determined by the distance between the upper and lower contact surfaces 7. Similarly, the upper and lower contact surfaces 6 of the intermediate slide segment 3 must be adequate to receive the inner slide segment 2, the height of which is determined by the distance between the upper and lower contact surfaces 5. As a result of the flat contact surfaces, the height between the contact surfaces must be consistently maintained throughout the length of the surface. That is, the angle of the transverse portions of the segments relative to the web portions, must be consistently maintained. Because this is difficult to achieve in practice, the distances between the contact surfaces may be purposely enlarged to account for normal manufacturing tolerances in the distance between the contact surfaces and the angle of the transverse portions. However, such a practice results in at least a portion of the slide assemblies produced having an undesirable amount of relative vertical movement permitted between the individual slide segments.

In contrast, the height between the contact surfaces in preferred embodiments of the present slide assembly 14 need only be maintained at the contact point, or the small contact area between the individual segments 16, 18, 20, as described in detail above. Such a result is easier and cheaper to maintain through normal manufacturing processes, which results in a tighter tolerance range and, thus, reduced vertical clearance between the individual slide segments 16, 18, 20. As a result, the perceived quality of the slide assembly 14 is improved, without increasing manufacturing costs.

A slide assembly 14 constructed substantially as described above provides improved sliding movement over the prior art slide 1 of FIG. 1. For instance, the maximum force necessary to cause initial movement of the slide assembly 14 (i.e., to overcome the static friction force) is reduced with preferred embodiments of the present slide assembly 14 over the prior art slide 1. This permits the server 10, or other object supported by the slide assembly 14, to smoothly begin movement from an at rest position, without a sudden surge, as may occur with slides having a high static friction resistive force. Further, once in motion, less force is necessary to maintain motion of the slide assembly 14 (i.e., to overcome the maximum dynamic friction force) in comparison with the prior art slide 1. Accordingly, the server 10, or other supported object, may be extended or retracted with greater ease than with other solid bearing slide assemblies.

Although the present invention has been described in the context of a preferred embodiment, it is not intended to limit the invention to the provided example. Modifications to the slide assembly 14 that are apparent to one of skill in the art are considered to be a part of the present invention. For example, although a three-piece slide assembly is illustrated, the principles disclosed herein may similarly be applied to a two-piece slide assembly. Further, although the illustrated slide assembly 14 is arranged for vertical mounting applications, the present invention may also be adapted for horizontal, or other mounting configurations. In addition, the slide assembly 14 may be adapted for horizontal, or other than computer server mounting applications and, therefore, may take on alternative cross-sectional dimensions or lengths. Accordingly, the invention should be defined solely by the appended claims.

What is claimed is:

1. A slide assembly, comprising:

a first slide segment having a web, a first upper portion and a first lower portion spaced from one another along said web, said first upper portion defining a lower curved surface and said first lower portion defining an upper curved surface;

a second slide segment telescopingly engaged with said first slide segment, said second slide segment having a web, a second upper portion and a second lower portion spaced from one another along said web, said second upper portion having a curved portion defining an innermost vertical surface, an outermost vertical surface and an upper curved surface extending between said innermost surface and said outermost surface of said second upper portion, said second lower portion having a curved portion defining an innermost vertical surface, an outermost vertical surface and a lower curved surface extending between said innermost surface and said outermost surface of said second lower portion;

wherein said lower curved surface of said first upper portion is configured to directly contact said upper curved surface of said second upper portion and said upper curved surface of said first lower portion is configured to directly contact said lower curved surface of said second lower portion, and wherein a radius of said upper curved surface of said second upper portion and a radius of said lower curved surface of said second lower portion are between about 30% to 95% of a radius of said lower curved surface of said first upper portion and a radius of said upper curved surface of said first lower portion, respectively; and a third slide segment telescopingly engaged with said second slide segment and including a web, a third upper portion and a third lower portion spaced from one another along said web, said third upper portion contacting said second upper portion and said third lower portion contacting said second lower portion;

wherein said second upper portion comprises a lower curved surface and said second lower portion comprises an upper curved surface, said third upper portion comprising a curved portion defining an upper curved surface and said third lower portion comprising a curved portion defining a lower curved surface, and wherein said lower curved surface of said second upper portion is configured to directly contact said upper curved surface of said third upper portion and said upper curved surface of said second lower portion is configured to directly contact said lower curved surface of said third lower portion.

2. The slide assembly of claim 1, wherein a radius of said upper curved surface of said second upper portion and a radius of said lower curved surface of said second lower portion are between about 30% to 45% of a radius of said lower curved surface of said first upper portion and a radius of said upper curved surface of said first lower portion, respectively.

3. The slide assembly of claim 1, wherein a radius of said upper curved surface of said second upper portion and a radius of said lower curved surface of said second lower portion is about 37% of a radius of said lower curved surface of said first upper portion and a radius of said upper curved surface of said first lower portion, respectively.

4. The slide assembly of claim 1, wherein a radius of said upper curved surface of said second upper portion and a radius of said lower curved surface of said second lower portion are between about 80% to 95% of a radius of said lower curved surface of said first upper portion and a radius of said upper curved surface of said first lower portion, respectively.

5. The slide assembly of claim 1, wherein a radius of said upper curved surface of said second upper portion and a radius of said lower curved surface of said second lower portion are between about 80% to 90% of a radius of said lower curved surface of said first upper portion and a radius of said upper curved surface of said first lower portion, respectively.

6. The slide assembly of claim 1, wherein a radius of said upper curved surface of said second upper portion and a radius of said lower curved surface of said second lower portion is about 86% of a radius of said lower curved surface of said first upper portion and a radius of said upper curved surface of said first lower portion, respectively.

7. The slide assembly of claim 1, wherein substantially only a midpoint of said lower curved surface of said first upper portion contacts substantially only a midpoint of said upper curved surface of said second upper portion and substantially only a midpoint of said upper curved surface of said first lower portion contacts substantially only a midpoint of said lower curved surface of said second lower portion.

8. The slide assembly of claim 7, wherein substantially only a midpoint of said lower curved surface of said second upper portion contacts substantially only a midpoint of said upper curved surface of said third upper portion and substantially only a midpoint of said upper curved surface of said second lower portion contacts substantially only a midpoint of said lower curved surface of said third lower portion.

9. A slide assembly, comprising:

a first slide segment having a web, a first upper portion and a first lower portion spaced from one another along said web, said first upper portion defining a curved contact surface and said first lower portion defining a curved contact surface;

a second slide segment telescopingly engaged with said first slide segment and having a web, a second upper portion and a second lower portion spaced from one another along said web;

a third slide segment having a web, a third upper portion and a third lower portion spaced from one another along said web, said third upper portion defining a curved contact surface and said third lower portion defining a curved contact surface;

wherein a first curved surface of said second upper portion is in direct contact with a portion of said contact surface of said first upper portion and a first curved surface of said second lower portion is in direct contact with a portion of said contact surface of said first lower portion and, wherein further, a second curved surface of said second upper portion is in direct contact with a portion of said contact surface of said third upper portion and a second curved surface of said second lower portion is in direct contact with a portion of said contact surface of said third lower portion; and wherein said portion of said contact surfaces of said first upper portion, said first lower portion, said third upper portion and said third lower portion comprise substantially a midpoint of said contact surfaces.

10. The slide assembly of claim 9, wherein a radius of said contact surfaces of said first upper portion and said first lower portion are between about 30% to 95% of a radius of said first curved surface of said second upper portion and a radius of said first curved surface of said second lower portion, respectively, and wherein a radius of said second curved surface of said second upper portion and a radius of said second curved surface of said second lower portion are between about 80% to 95% of a radius of said contact surfaces of said third upper portion and said third lower portion, respectively.

11. The slide assembly of claim 9, wherein a radius of said contact surfaces of said first upper portion and said first lower portion are between about 30% to 45% of a radius of said first curved surface of said second upper portion and a radius of said first curved surface of said second lower portion, respectively, and wherein a radius of said second curved surface of said second upper portion and a radius of said second curved surface of said second lower portion are between about 80% to 90% of a radius of said contact surfaces of said third upper portion and said third lower portion, respectively.

12. The slide assembly of claim 9, wherein a radius of said contact surfaces of said first upper portion and said first lower portion is about 37% of a radius of said first curved surface of said second upper portion and a radius of said first curved surface of said second lower portion, respectively, and wherein a radius of said second curved surface of said second upper portion and a radius of said second curved surface of said second lower portion is about 86% of a radius of said contact surfaces of said third upper portion and said third lower portion, respectively.

* * * * *